United States Patent [19]

Levinson

[11] 4,433,657

[45] Feb. 28, 1984

[54] MODIFICATION OF AN INTERNAL COMBUSTION ENGINE SO AS TO OPERATE PERMANENTLY WITH A REDUCED NUMBER OF CYLINDERS

[76] Inventor: George Levinson, 105-75 Flatlands First St., Brooklyn, N.Y. 11236

[21] Appl. No.: 293,423

[22] Filed: Aug. 17, 1981

[51] Int. Cl.[3] ..... F02D 13/06

[52] U.S. Cl. ..... 123/198 F; 123/DIG. 1; 123/DIG. 7; 123/193 P

[58] Field of Search ..... 123/198 F, DIG. 7, 193 P, 123/DIG. 1, 1 R

[56] References Cited

U.S. PATENT DOCUMENTS 3,874,358 4/1975 Crower ..... 123/DIG. 7

4,070,971 1/1978 Studebaker ..... 123/DIG. 7

OTHER PUBLICATIONS

The Mother Earth News, "Convert Your V-8 to a V-4," Michael Roach, Jul./Aug. 1979, pp. 144, 145.

*Primary Examiner*—Ira S. Lazarus

*Attorney, Agent, or Firm*—Ladas & Parry

[57] ABSTRACT

A method of reducing the number of operative cylinders in an internal combustion engine, and an engine produced according to the method. The cylinder head is removed. A hole is formed in at least one initially operative piston associated with at least one cylinder. The head is replaced. The intake manifold is removed. The valve push rods and valve lifters associated with the cylinder are removed. The exit ports of oil opening into the bores for the valve lifters associated with the cylinder are sealed. The intake manifold is replaced.

6 Claims, 4 Drawing Figures

MODIFICATION OF AN INTERNAL COMBUSTION ENGINE SO AS TO OPERATE PERMANENTLY WITH A REDUCED NUMBER OF CYLINDERS

This invention relates to modification of an internal combustion engine so as to operate permanently with a reduced number of cylinders.

One type of internal combustion engine comprises a cylinder block formed with an integral number n of cylinders, each of which has a piston fitted reciprocatably therein. At least one cylinder head is secured to the cylinder block, and by removal of the cylinder head(s) access is provided to the cylinders and to the crowns of the pistons. The pistons are connected, through respective connecting rods, to a crankshaft upon which the connecting rods are journalled. Lubricating oil is fed to the relatively moving surfaces of the crankshaft and the connecting rod through a passageway which is formed in the crankshaft and opens to the exterior of the crankshaft in an exit port which is normally covered by the connecting rod. The engine further comprises an intake valve and an exhaust valve associated with each cylinder. The valves are opened and closed in timed relationship to the reciprocation of the associated piston by means of a camshaft, which rotates at half the rate of the crankshaft, and an actuating train including a push rod and a hydraulic valve lifter disposed in a bore in the cylinder block. Oil is fed to the valve lifter through a passageway which is formed in the cylinder block and opens into the bore in the cylinder block by way of an exit port. A crankcase and an intake manifold are secured to the cylinder block. The crankshaft is accessible by removal of the crankcase and the valve actuating train is accessible by removal of the intake manifold. This type of internal combustion engine will be referred to hereinafter as "an internal combustion engine of the type defined".

According to a first aspect of the present invention there is provided a method of converting an internal combustion engine of the type defined from operation with n cylinders to operation with m cylinders, where m is a positive integer less than n, comprising the following steps (a), (b) and (c), steps (a) and (b) not necessarily being performed in the order stated:

(a) removing the crankcase from the cylinder block, detaching from the crankshaft the connecting rod associated with at least one cylinder, thereby exposing the lubricating oil exit port for said connecting rod, and removing the piston associated with said one cylinder from the cylinder block, sealing the exposed exit port to prevent escape of oil from said port, and replacing the crankcase;

(b) removing the intake manifold, removing the valve push rods and hydraulic valve lifters associated with said one cylinder, sealing the exit ports for oil opening into the bores for the valve lifters associated with said one cylinder, and replacing the intake manifold; and (c) checking the balance of the engine and, if necessary, adjusting the engine to place it in balanced condition.

According to a second aspect of the present invention there is provided an internal combustion engine comprising a cylinder block formed with n cylinders, and a crankshaft for having n connecting rods journalled thereon to connect the crankshaft to respective pistons fitted reciprocatably in the n cylinders respectively, said crankshaft being formed with a passageway which opens to the exterior of the crankshaft in n exit ports for feeding lubricating oil to the bearing surfaces for the connecting rods respectively, said cylinder block also being formed with n pairs of bores associated with the cylinders respectively for receiving actuating trains for inlet and exhaust valves, and with passageways which open to the interior of said bores in exit ports for feeding oil to the bores, and the engine further comprising m pistons, where m is a positive integer less than n, fitted reciprocatably in respective ones of the n cylinders, m connecting rods journalled on the crankshaft and connecting the crankshaft to the m pistons respectively, 2 m valve actuating trains fitted in the m pairs of bores associated with the cylinders in which the m pistons are fitted, means for blocking flow of oil from the or each of the exit ports, opening to the exterior of the crankshaft, associated with the or each cylinder without a piston fitted therein, and means for blocking flow of oil from the exit ports, opening to the interiors of the bores associated with the or each cylinder without a piston fitted therein.

According to a third aspect of the present invention there is provided a method of converting an internal combustion engine of the type defined from operation with n cylinders to operation with m cylinders, where m is a positive integer less than n, comprising the following steps (a), (b) and (c), steps (a) and (b) not necessarily being performed in the order stated:

(a) removing the cylinder head from the cylinder block and forming in the crown of the piston associated with at least one cylinder a hole which is of substantial cross-sectional area relative to the cross-sectional area of the cylinder, and replacing the cylinder head;

(b) removing the intake manifold, removing the valve push rods and hydraulic valve lifters associated with said one cylinder, sealing the exit ports for oil opening into the bores for the valve lifters associated with said one cylinder, and replacing the intake manifold; and (c) checking the balance of the engine and, if necessary, adjusting the engine to place it in balanced condition.

According to a fourth aspect of the present invention there is provided an internal combustion engine comprising a cylinder block formed with n cylinders, and a crankshaft for having n connecting rods journalled thereon to connect the crankshaft to respective pistons fitted reciprocatably in the n cylinders respectively, said crankshaft being formed with a passageway which opens to the exterior of the crankshaft in n exit ports for feeding lubricating oil to the bearing surfaces for the connecting rods respectively, said cylinder block also being formed with n pairs of bores associated with the cylinders respectively for receiving actuating trains for inlet and exhaust valves, and with passageways which open to the interior of said bores in exit ports for feeding oil to the bores, and the engine further comprising n pistons fitted reciprocatably in the n cylinders respectively, at least one but less than all of said pistons being formed in its crown with a hole which is of substantial cross-sectional area relative to the cross-sectional area of the cylinder, n connecting rods journalled on the crankshaft and connecting the crankshaft to the n pistons respectively, valve acuating trains fitted in the bores associated with the cylinders in which the pistons without holes are fitted, and means for blocking flow of oil from the exit ports, opening to the interiors of the bores associated with the or each cylinder having fitted therein a piston with a hole.

For a better understanding of the invention, and to show how the same may be carried into effect, reference will now made, by way of example, to the accompanying drawings in which.

Figure 1:
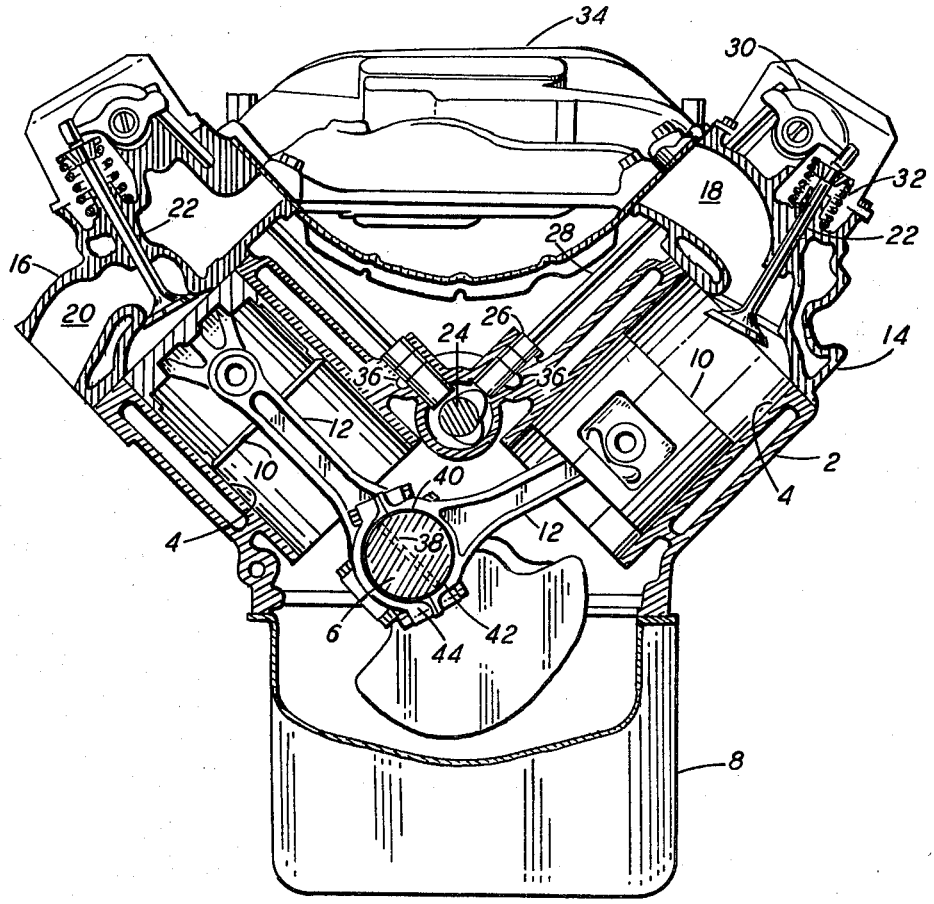
FIG. 1 shows an end view, partly in elevation and partly in section, of a conventional internal combustion engine.

The engine illustrated in FIG. 1 is a conventional 400 cubic inch V8 engine manufactured by General Motors Corporation and described in the 1968 Buick Chassis Service Manual. Only those parts relevant to the present invention are illustrated. The engine comprises a cylinder block 2 formed with two banks of cylinders 4 disposed at 90° to each other. Mounted within the cylinder block by means of bearings (not shown) is a crankshaft 6. A crankcase 8 is bolted to the cylinder block 2 beneath the crankshaft 6, so that removal of the crankcase provides access to the crankshaft.

A piston 10 is fitted reciprocatably in each of the cylinders, the pistons being connected to the crankshaft by means of connecting rods 12. Reciprocation of the pistons in the cylinders is associated with rotation of the crankshaft. Two cylinder heads 14 and 16 are secured to the cylinder block 2 for closing off the two banks of cylinders respectively. Each cylinder head is formed with an intake passage 18 and an exhaust passage 20 associated with each cylinder of the bank with which the cylinder head is associated. These passages are provided with respective valves 22. The valves 22 are actuated by means of a camshaft 24 which is mounted in the cylinder block and is connected drivingly to the crankshaft to rotate at the same speed as the crankshaft. The camshaft opens the valves at predetermined times through respective actuating trains each comprising a hydraulic valve lifter 26, a push rod 28 and a rocker 30. When the camshaft does not cause the valve to open, a valve spring 32 forces the valve closed.

The exhaust passages of the two cylinder heads communicate with respective exhaust manifolds (not shown), whereas the intake passages 18 communicate with a common intake manifold 34.

The cylinder block is formed with oil galleries which run the full length of the cylinder block and serve to deliver oil under pressure to the hydraulic valve lifters and to the crankshaft and camshaft bearings. (Only the galleries 36 which serve the valve lifters are shown.) Holes 38 drilled in the crankshaft carry oil from the crankshaft bearings to the connecting rod bearings 40.

In order to convert the V8 engine to operate as a V6 engine, it is necessary that two of the cylinders be rendered inoperative. This is achieved, in accordance with the invention, in one of two ways.

Figure 2:
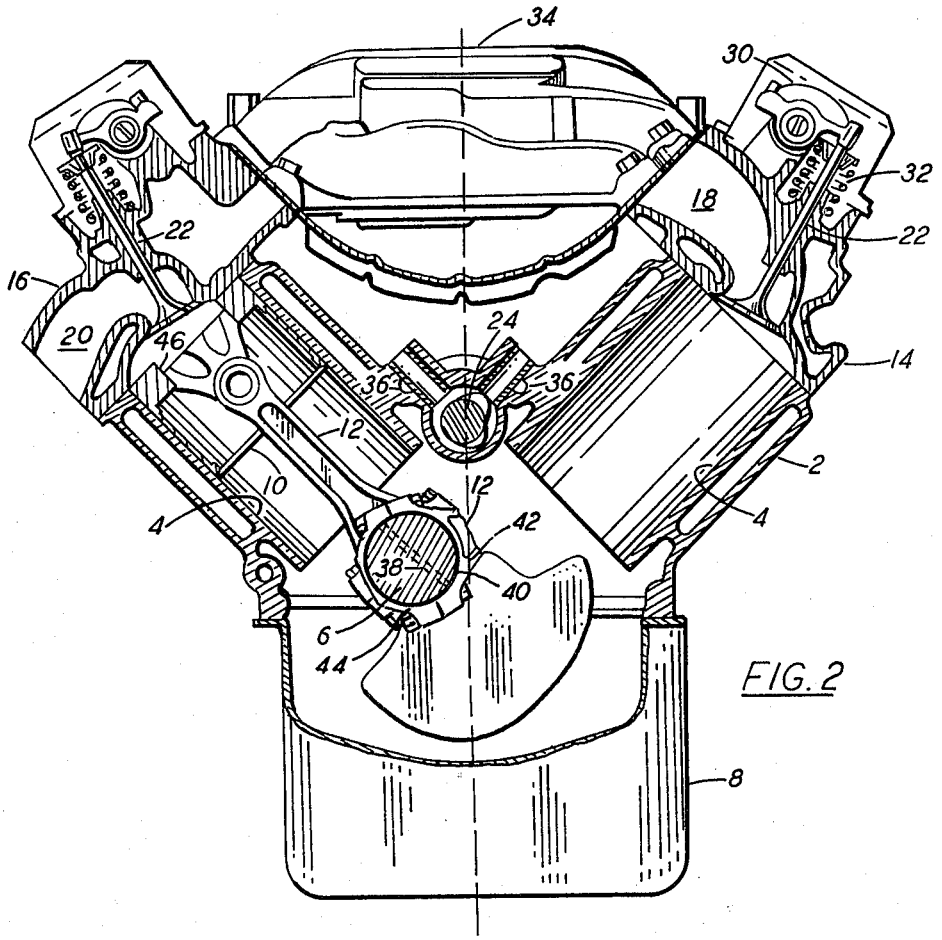
FIG. 2 shows on the left side a similar view of a first internal combustion engine embodying the present invention and, on the right side, a similar view of a second internal combustion engine embodying the present invention.
Figure 3:
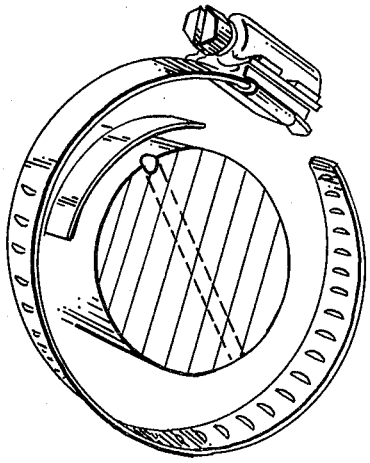
FIGS. 3 and 4 show sealing devices.
Figure 4:
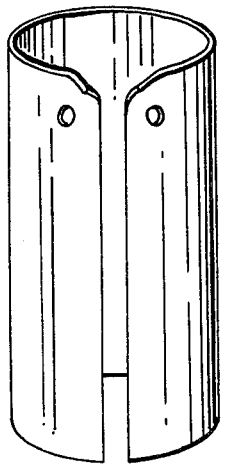

In accordance with the first method, illustrated on the right of FIG. 2, the crankcase is removed from the engine and two of the connecting rods, associated with pistons in the two banks respectively, are removed from the crankshaft. This permits the two pistons to be removed from the associated cylinders respectively. The holes for delivering oil to the connecting rod bearings associated with the two removed pistons are then blocked off by means of a hose clamp and neoprene strip as shown in FIG. 3 or by means of a clamp formed from the upper and lower bearing shells 42 and 44 of the connecting rod, by cutting off the rod itself.

The alternative method to render the two cylinders inoperative, illustrated on the left of FIG. 2, involves removing the cylinder heads 14 and 16, thus providing access to the crowns of the pistons, and drilling a hole 46 in the crown of one piston of each bank. As shown in FIG. 2, this hole is formed in regions of the crown removed from the circumferential edge of the piston. It will be noted that the hole is of large cross-sectional area relative to the cross-sectional area of the cylinder and does not extend to the periphery of the piston. This latter method has the advantage that it is not necessary to remove the crankcase or to remove the pistons.

It is also necessary to ensure that fuel and exhaust gases do not enter the inoperative cylinders, and in order to do this the valves are permanently closed. This is achieved by removing the intake manifold and removing the hydraulic valve lifters and push rods associated with the valves. The valve springs 32 then hold the valves closed. In order to prevent escape of oil from the galleries 36 which serve the valve lifters, a sealing member comprising a spring steel sleeve having a neoprene coating is inserted into the valve lifter guide in place of the removed lifter. The sleeve has to be squeezed in order to insert it into the guide, and upon removal of pressure the sleeve expands into intimate contact with the interior of the guide and closes off communication between the oil gallery and the guide. The intake manifold is then replaced.

As a final step, the balance of the engine is checked, and, if required, the engine is balanced using conventional means.

It will thus be seen that the present invention provides for permanently reducing the number of operative cylinders of the engine. This in turn leads to a significant reduction in fuel consumption.

It will be appreciated that the invention is not limited to the particular methods and constructions which have been shown and described, since changes may be made therein without departing from the scope of the invention as defined in the appended claims.

I claim:

1. A method of converting an internal combustion engine of the type defined from operation with n cylinders to operation with m cylinders, where m is a positive integer less than n, comprising the following steps (a), (b), and (c), steps (a), and (b) not necessarily being performed in the order stated:

(a) removing the cylinder head from the cylinder block and forming in the crown of an operative piston associated with at least one cylinder a hole which is of substantial cross-sectional area relative to the cross-sectional area of the cylinder, and replacing the cylinder head;

(b) removing the intake manifold, removing the valve push rods and hydraulic valve lifters associated with said one cylinder, sealing the exit ports for oil opening into the bores for the valve lifters associated with said one cylinder, and replacing the intake manifold; and (c) checking the balance of the engine and, if necessary, adjusting the engine to place it in balanced condition.

2. The method of claims 1 in which said hole is formed in said crown while said piston is in place in its respective cylinder.

3. The method of claim 1 in which said hole in said crown extends only over regions of said crown removed from the circumferential edge of said piston.

4. The method of claim 1 in which said hole is formed in said crown while said piston is in place in its respective cylinder and extends only over regions of said crown removed from the edge of said piston.

5. An internal combustion engine comprising a cylinder block formed with n cylinders, and a crankshaft for having n connecting rods journalled thereon to connect the crankshaft to respective pistons fitted reciprocatably in the n cylinders respectively, said crankshaft being formed with a passageway which opens to the exterior of the crankshaft in n exit ports for feeding lubricating oil to the bearing surfaces for the connecting rods respectively, said cylinder block also being formed with n pairs of bores associated with the cylinders respectively for receiving actuating trains for inlet and exhaust valves, and with passageways which open to the interior of said bores in exit ports for feeding oil to the bores, and the engine further comprising n initially operative pistons fitted reciprocatably in the n cylinders respectively, at least one but less than all of said initially operative pistons being formed in its crown with a hole which is of substantial cross-sectional area relative to the cross-sectional area of the cylinder, n connecting rods journalled on the crankshaft and connecting the crankshaft to the n pistons respectively, valve acuating trains fitted in the bores associated with the cylinders in which the pistons without holes are fitted, and means for blocking flow of oil from the exit ports, opening to the interiors of the bores associated with the or each cylinder having fitted therein a piston with a hole.

6. The engine of claim 5 in which the hole in said crown is formed only in regions of said crown removed from the circumferential edge of said piston.

* * * * *